US006761410B2

(12) United States Patent
Lee

(10) Patent No.: US 6,761,410 B2
(45) Date of Patent: Jul. 13, 2004

(54) GEAR-CONTROLLED HEIGHT-ADJUSTING MECHANISM FOR ARMREST OF OFFICE CHAIR

(76) Inventor: Ching-Yang Lee, No. 12, Fu Kuei Hsin Tsuen, Alley 6, Heng Shan Tsuen, Heng Shan Hsiang, Hsin Cuu Hsien (TW)

( * ) Notice: Subject to any disclaimer, the term of this patent is extended or adjusted under 35 U.S.C. 154(b) by 19 days.

(21) Appl. No.: 10/188,867

(22) Filed: Jul. 5, 2002

(65) Prior Publication Data

US 2004/0004385 A1 Jan. 8, 2004

(51) Int. Cl.[7] ..... A47C 7/54
(52) U.S. Cl. ..... 297/411.36
(58) Field of Search ..... 297/411.36, 353; 74/422

(56) References Cited

U.S. PATENT DOCUMENTS 5,405,189 A * 4/1995 Stumpf ..... 297/353
5,620,233 A * 4/1997 Corwin ..... 297/411.36
5,795,026 A * 8/1998 Dral et al. ..... 297/411.36
5,895,095 A * 4/1999 Chen ..... 297/411.36
6,398,309 B1 * 6/2002 Chen ..... 297/411.36
6,419,323 B1 * 7/2002 Chu et al. ..... 297/411.36
6,533,355 B2 * 3/2003 Broekhuis et al. ..... 297/353

* cited by examiner

*Primary Examiner*—Peter M. Cuomo
*Assistant Examiner*—Stephen Vu
(74) *Attorney, Agent, or Firm*—Troxell Law Office PLLC

(57) ABSTRACT

A gear-controlled height-adjusting mechanism for armrest of office chair mainly includes an armrest support received in a housing, an elongated slide member vertically movably connected to an upper outer side of the armrest support and having a bottom rack, and a gear set mounted on the armrest support. The gear set includes a driving gear meshing with the rack, and a driven gear meshing with a vertical row of locating holes provided in the housing. The height-adjusting mechanism further includes a release mechanism for freely lowering the armrest support to a desired height. To adjust the armrest to a higher position, simply alternately upward pull and release the slide member for the bottom rack to forward rotate the driving gear and accordingly the driven gear. When the forward rotating driven gear engages with the locating holes, the armrest support is gradually moved upward in multiple stages.

8 Claims, 4 Drawing Sheets

GEAR-CONTROLLED HEIGHT-ADJUSTING MECHANISM FOR ARMREST OF OFFICE CHAIR

FIELD OF THE INVENTION

The present invention relates to a gear-controlled height-adjusting mechanism for armrest of office chair, and more particularly to a gear-controlled height-adjusting mechanism that enables the armrest of an office chair to move upward in multiple stages and to move downward freely to a desired or a lowest position possible.

BACKGROUND OF THE INVENTION

The currently available office chairs include armrests that are differently designed to show various appearances, and are provided with different adjusting structures for users to conveniently adjust the height and/or the openness of the armrests, so that the office chairs are more comfortable for sitting and have increased value. U.S. Pat. No. 6,336,680 B1 granted to the same applicant discloses a height-adjusting structure for armrest, in which each armrest is allowed to freely move up and down during the height adjustment. It is uneasy for a user to control the adjusting structure and accurately locate the armrests at a selected height, and the armrests tend to unnecessarily slide all the way down to a lowest position.

SUMMARY OF THE INVENTION

It is a primary object of the present invention to provide a gear-controlled height-adjusting mechanism for armrest of office chair, with which the armrest of the office chair can be adjusted to a higher position in multiple stages and to a desired lower position freely via a release mechanism.

To achieve the above and other objects, the height-adjusting mechanism of the present invention mainly includes:

an armrest support being generally in the shape of letter T to include a flat top portion for an armrest to mount thereto and a flat long body downward extended from the flat top portion for fixing to one side of an office chair;

a housing being provided at one side of an inner wall surface with a vertical row of equally spaced locating holes, and the armrest support being upward and downward slidably mounted in the housing;

an elongate slide member being movably connected to an upper outer side of the armrest support, such that the slide member can be pulled upward and released to elastically return to an initial lower position, and the slide member including a handle laterally outward extended from a top of the slide member, and a rack downward extended from a lower end of the slide member with teeth of the rack projected toward the armrest support; and a gear set including a driving gear and a driven gear, which are connected to each other with a pivotal shaft to mount in an opening provided at a middle portion of the armrest support, the driving gear meshing with the rack on the slide member, the driven gear including a transmission gear and a locating gear that are integrally formed into one unit, the transmission gear having teeth adapted to engage with the locating holes on the housing; and the gear set also including a unidirectional catch means provided between the driving gear and the driven gear, the unidirectional catch means being adapted to bring the driven gear to rotate forward along with the driving gear when the latter rotates forward, and to idle when the driving gear rotates in a reverse direction.

Whereby when the handle of the slide member is alternately pulled upward and released, the driving gear meshing with the rack is caused by the rack to rotate forward and backward, respectively, and the driven gear is caused by the unidirectional catch means to rotate in one forward direction with teeth of the transmission gear engaging with the locating holes on the housing to gradually move the armrest support upward in multiple stages and guided by the spaced locating holes.

The present invention also includes a release mechanism that includes a vertically extended long slot provided near an upper end of the armrest support, a bar horizontally projected from an upper rear end of the slide member for extending through the long slot, a push member pivotally connected at an end via a pivotal shaft to a rear side of the armrest support to locate above and abut at a lower middle point on the bar extended through the long slot, a return spring mounted between the flat top portion of the armrest support and the push member to normally push the push member to a low position, and a vertically extended link having an upper end connected to another end of the push member opposite to the pivotal shaft and a lower end engaged with a catch pawl member mounted on the armrest support to engage with the locating gear. Whereby when the slide member is pulled to a highest position possible, the rearward extended bar drives the push member to pivotally turn about the pivotal shaft and accordingly lift the link, causing the catch pawl member connected to the lower end of the link to pivotally rotate and disengage from the locating gear, and therefore allowing the locating gear to idle freely and the armrest support to be freely pushed downward.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
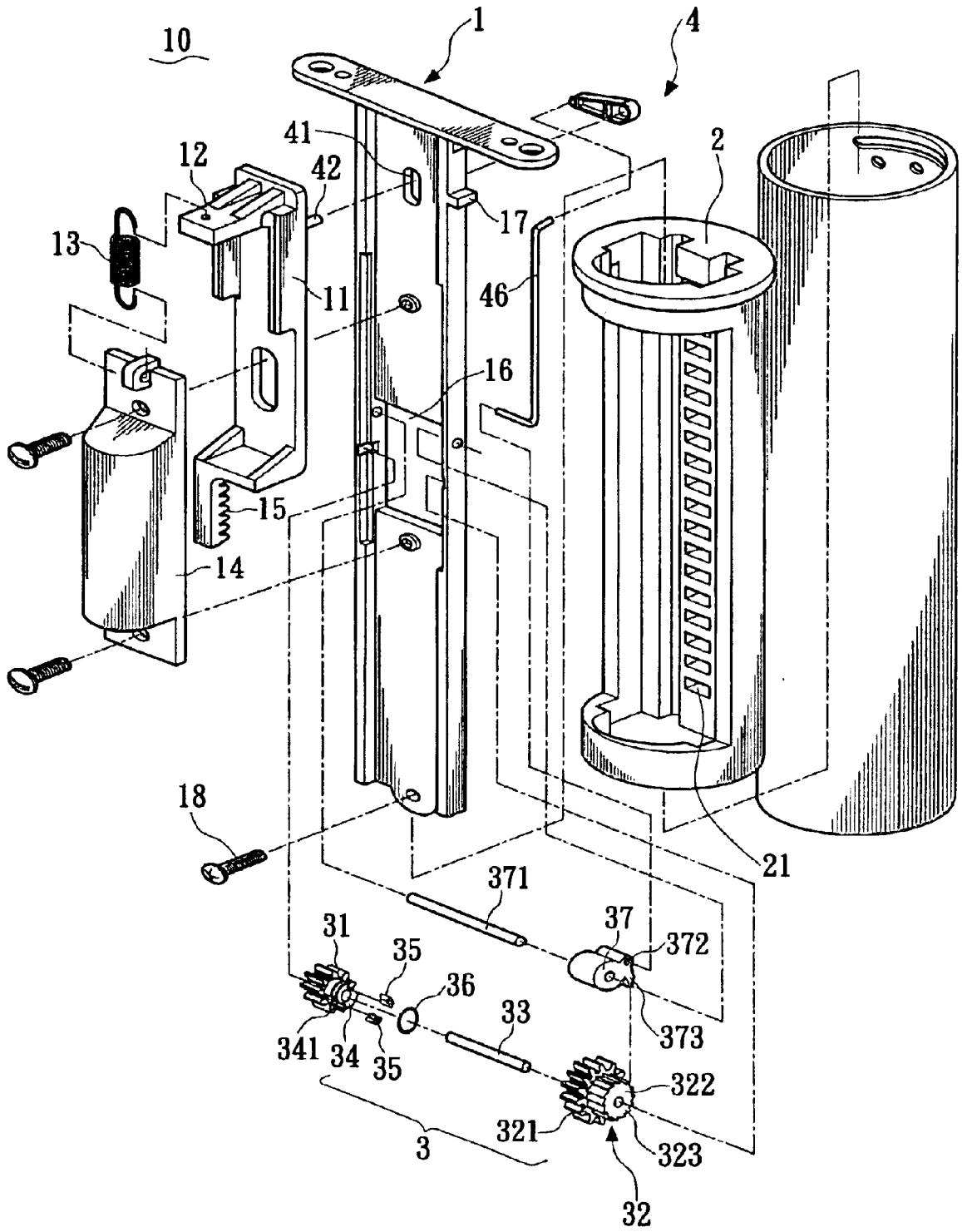
FIG. 1 is an exploded perspective view of the present invention.
Figure 2A:
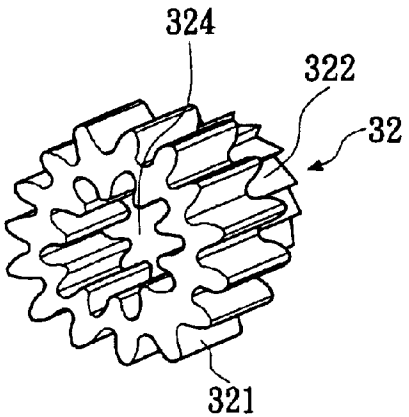
FIG. 2A is a driven gear included in the gear set of FIG. 2 viewed from an opposite side thereof.
Figure 2:
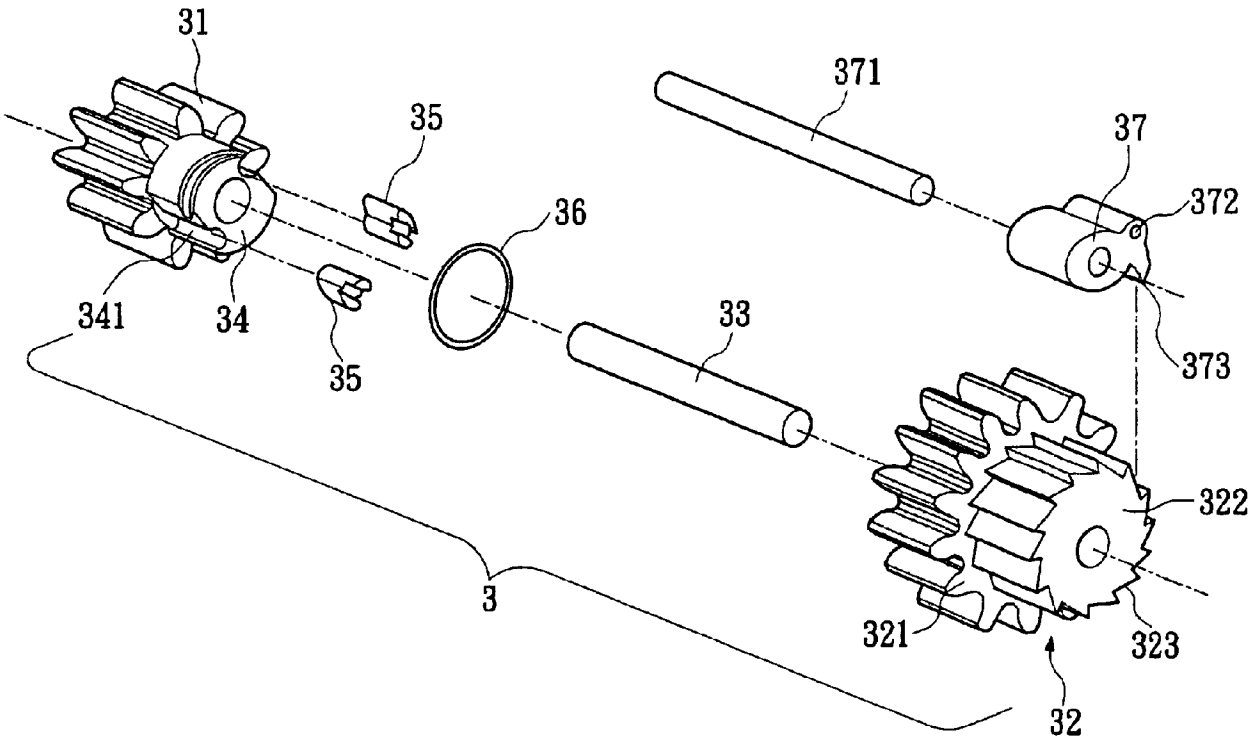
FIG. 2 is an enlarged exploded perspective view of a gear set included in the present invention.

Please refer to FIGS. 1, 2, 2A, 3 and 4 at the same time, in which a gear-controlled height-adjusting mechanism 10 for armrest of office chair according to the present invention is shown. As shown, the height-adjusting mechanism 10 mainly includes a generally T-shaped armrest support 1 having a flat top portion for an armrest (not shown) to mount thereto and a flat long body downward extended from the flat top portion for fixing to one side of an office chair, and a housing 2 for receiving the long body of the armrest support 1 therein. The housing 2 is provided at one side of an inner wall surface with a vertical row of equally spaced locating holes 21.

An elongate slide member 11 is movably connected to an upper outer side of the armrest support 1. The slide member 11 includes a handle 12 laterally outward extended from a top thereof. A spring 13 is connected at an upper end to a lower outer end of the handle 12 and at a lower end to a top of a cover 14, which is screwed to the long body of the armrest support 1 to shield accessories and parts mounted on the armrest support 1 and to prevent the same from separating from the armrest support 1. The slide member 11 may be upward pulled at the handle 12 relative to the armrest support 1 by a predetermined distance, and can automatically returns to an initial lower position due to a restoring force of the spring 13 when the handle 12 is released. A length of rack 15 is extended from a lower end of the slide member 11 with teeth of the rack 15 projected toward the armrest support 1.

The armrest support 1 is provided near a middle portion with an opening 16, into which a gear set 3 is mounted to mesh with the rack 15 when the slide member 11 is in its initial lower position. When the cover 14 is screwed to the armrest support 1, it also shields the gear set 3.

The gear set 3 includes a driving gear 31 and a driven gear 32, which are connected to each other with a pivotal shaft 33 extended through central holes of the two gears 31, 32. The driving gear 31 meshes with the rack 15 on the slide member 11, and includes a base 34 axially projected from one side thereof toward the driven gear 32. The axially projected base 34 is formed on a circumferential surface at two diametrically opposite sides with two curved recesses 341 for each receiving a ratchet 35 therein. The ratchets 35 (two are shown in the drawings) are held to the base 34 with a retaining ring 36, such that they could elastically swing by a small span in one direction only, that is, to swing rearward only.

The driven gear 32 includes a transmission gear 321 and a locating gear 322 that are integrally formed into one unit. The transmission gear 321 has teeth adapted to engage with the locating holes 21 on the housing 2, and defines a central hole 324 having radially extended valleys and teeth alternated along an inner wall of the central hole 324. The base 34 of the driving gear 31 is received in the central hole 324 of the transmission gear 321 with the two ratchets 35 separately engaging with one of the valleys.

Whenever the slide member 11 is upward pulled once, the rack 15 drives the driving gear 31 to rotate forward. At this point, the two ratchets 35 are caused to abut against one side of the valleys with which the ratchets 35 separately engage, so that the transmission gear 321 is brought to rotate along with the driving gear 31 at the same time. And, whenever the slide member 11 is released and elastically returns to its initial lower position due to the restoring force of the spring 13, the rack 15 drives the driving gear 31 to rotate in reverse direction. Since the two ratchets 35 are designed to elastically swing by a small span in the reverse direction only, the reverse rotation of the driving gear 31 will bring the ratchets 35 to move rearward and pass over the tooth adjacent to the valley with which it engages. That is, the transmission gear 321 idles without rotating along with the reversing driving gear 31.

A catch pawl member 37 is supported on a pivotal shaft 371 that is mounted on the armrest support 1 above the locating gear 322. The catch pawl member 37 is provided at one side with a hooking hole 372 and a retaining tooth 373 adapted to bear against a tooth flank 323 of the locating gear 322. When the locating gear 32 rotates forward, it may easily pass the retaining tooth 373 on the catch pawl member 37 to keep rotating forward without being retained by the retaining tooth 373. And, when the locating gear 32 rotates in a reverse direction, it is caught by the retaining tooth 373 and stopped from further rotating in the reverse direction.

The present invention also includes a release mechanism 4 that includes a vertically extended long slot 41 provided near an upper end of the main body of the armrest support 1, a bar 42 horizontally projected from an upper rear end of the slide member 11 for extending through the long slot 41, a push member 43 being pivotally connected at an end via a pivotal shaft 45 to a rear side of the armrest support 1 to locate above and abut at a lower middle point on the bar 42 extended through the long slot 41, a return spring 44 mounted between the flat top portion of the armrest support 1 and the push member 43 to normally push the push member 43 to a low position, and a vertically extended link 46 having an upper end connected to another end of the push member 43 opposite to the pivotal shaft 45 and a lower end engaged with the hooking hole 372 on the catch pawl member 37. When the link 46 is caused to move upward, the catch pawl member 37 is brought to pivotally rotate and the retaining tooth 373 to disengage from the tooth flank 323 of the locating gear 322, allowing the locating gear 322 to idle freely.

To adjust the armrest of the office chair to a higher position, simply upward pull the handle 12 of the slide member 11, and the rack 15 at the lower end of the slide member 11 would bring the driving gear 31 of the gear set 3 to rotate forward. The ratchets 35 on the axially extended base 34 of the forward rotating driving gear 31 are engaged with two valleys on the central hole 324 of the transmission gear 321 to bring the latter to rotate along with the driving gear 31 synchronously. Since the locating gear 322 is integrally formed with the transmission gear 321, it also rotates forward along with the transmission gear 321 at the same time. As mentioned above, the transmission gear 321 has teeth adapted to engage with the locating holes 21 on the housing 2. When the transmission gear 321 rotates forward, the engagement of its teeth with the locating holes 21 causes the whole driven gear 32 to move upward by at least one locating hole 21, depending on the number of teeth of the rack 15 being upward pulled each time. Thus, the whole armrest support 1, along with the armrest connected to the top thereof, is lifted by at least a distance defined by one locating hole 21. Since the locating gear 322 is caught by the retaining tooth 373 of the catch pawl member 37 and does not turn in a reverse direction, enabling the transmission gear 321 to maintain engaged with the locating holes 21 and thereby hold the armrest support 1 to the lifted position. The lifted armrest support 1 is ready for a next upward pull without the risk of automatically moving downward.

When the upward pulled handle 12 is released, the slide member 11 is downward pulled by the restoring force of the spring 13 to its initial lower position, and the rack 15 also brings the driving gear 31 to rotate in a reverse direction. Since the ratchets 35 on the base 34 of the driving gear 31 is adapted to swing by a small span in reverse direction only, they will idle in the central hole 324 of the transmission gear 321 without bringing the latter to rotate reversely along with the driving gear 31. Meanwhile, the locating gear 322 is kept caught by the retaining tooth 373 of the catch pawl member 37 and could not turn reversely. That is, when the handle 12 is released, the slide member 11 alone is lowered to its initial position while the transmission gear 321 and the locating gear 322 of the driven gear 32 are kept at the higher position on the vertical row of locating holes 21 in the housing 2. By alternately pulling and releasing the handle 12, the armrest of the office chair is gradually lifted in multiple stages. The adjustment of the vertical position of the armrest is therefore easy and stable.

To lower the armrest to a desired height or to a lowest position for a user to adjust the armrest from the very beginning, simply upward pull the handle 12 to a highest point possible. At this point, the bar 42 projected from the upper rear end of the slide member 11, which is extended through the armrest support 1 to normally abut on the lower middle point of the push member 43, would upward press against the push member 43, causing the latter to pivotally turn about the pivotal shaft 45 and therefore lift the link 46 opposite to the pivotal shaft 45. The lifted link 46 brings the retaining tooth 373 of the catch pawl member 37, which is connected at the hooking hole 372 to the lower end of the link 46, to pivotally turn upward and therefore disengage from the tooth flank 323 of the locating gear 322. At this point, the driven gear 32 is no longer restrained by the catch pawl member 37 and the armrest support 1 may be freely pushed downward to any desired position.

Figure 3:
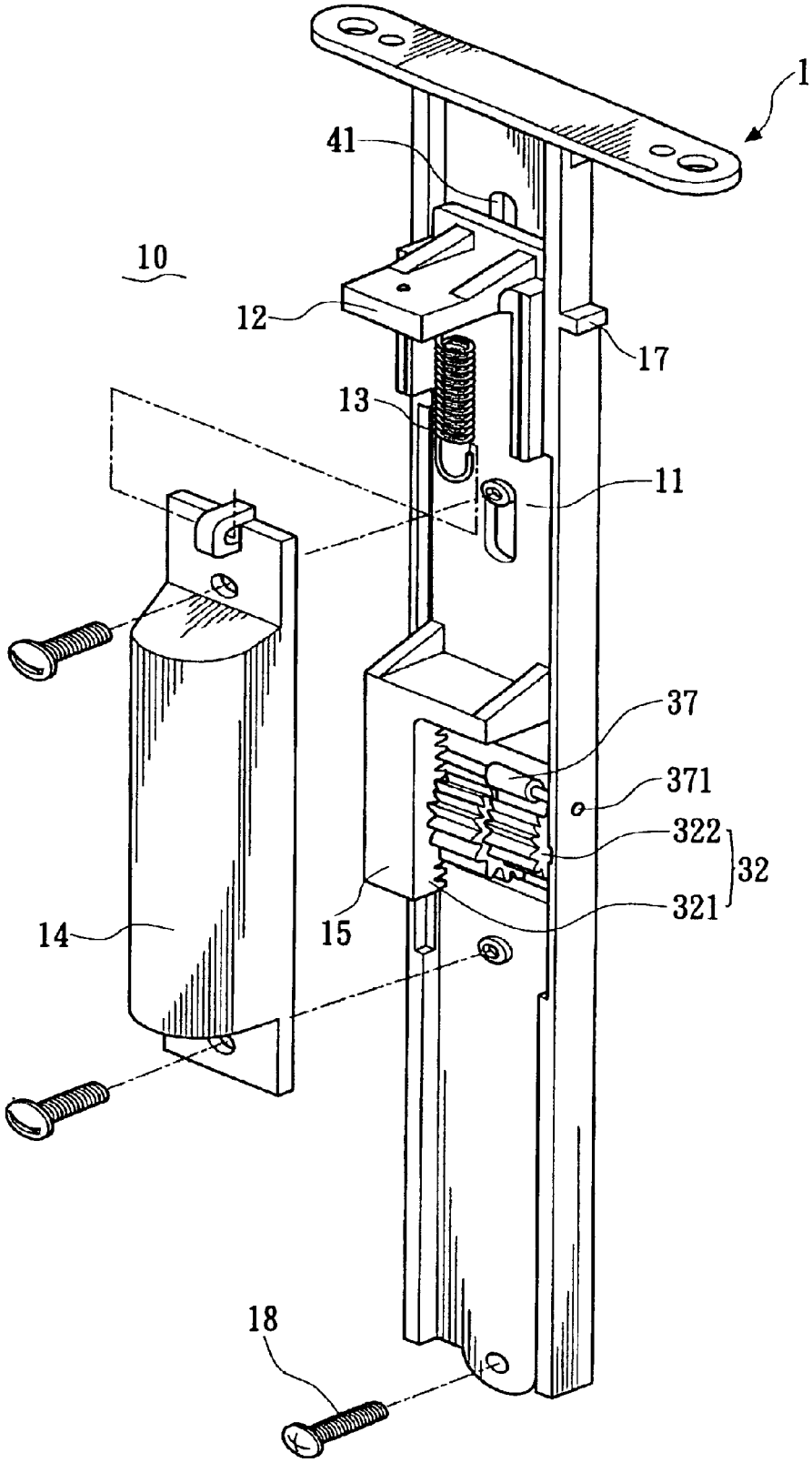
FIG. 3 is a front perspective view showing the assembling of the gear set, a release mechanism, and a slide member to an armrest support of the present invention.
Figure 4:
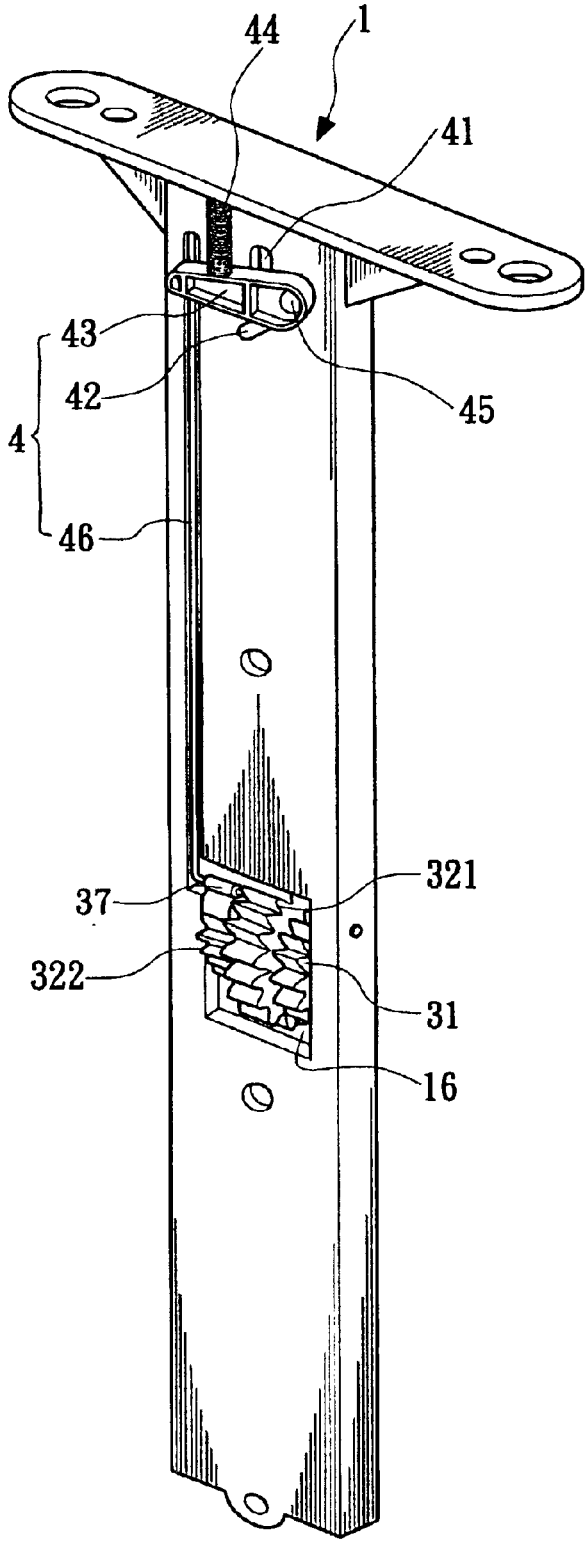
FIG. 4 is a rear view of FIG. 3.

Please refer to FIGS. 1 and 3. The armrest support 1 is provided at upper and lower ends with an upper protrusion 17 and a lower protrusion 18, respectively, which press against an upper and a lower end surface, respectively, of the housing 2 when the armrest support 1 is vertically moved in the housing 2. That is, the upper and the lower protrusions 17, 18 serve as lower and upper dead points, respectively, in the vertical movement of the armrest support 1 and the armrest to prevent the handle 12 on the armrest support 1 from contacting with the upper end surface of the housing 2 in a downward adjustment of the armrest support 1, or separating from the housing 2 in an upward adjustment of the armrest support 1.

In the gear-controlled height adjusting mechanism of the present invention, the gear set 3 enables the armrest of an office chair to be upward adjusted in multiple stages, and the release mechanism 4 enables the armrest to be freely lowered to a desired or the lowest position, so that the whole adjustment of the vertical position of the armrest could be easily and stably achieved.

What is claimed is:

1. A gear-controlled height-adjusting mechanism for an armrest of an office chair, comprising:

a T-shaped armrest support including a flat top portion for the armrest to mount thereto and a flat long body extending downwardly from said flat top portion for fixing to a side of the office chair;

a housing having at one side of an inner wall surface thereof a vertical row of equally spaced locating holes, wherein said armrest support is upwardly and downwardly slidably mounted in said housing;

an elongate slide member movably connected to an upper outer side of said armrest support, such that said slide member can be pulled upward and released to elastically return to a lower position relative to said armrest support, said slide member including a handle laterally outwardly extending from a top of said slide member, and a rack downwardly extending from a lower end of said slide member with a plurality of teeth of said rack projected toward said armrest support;

a gear set including a driving gear and a driven gear, which are connected to each other with a pivotal shaft to mount in an opening provided at a middle portion of said armrest support, said driving gear meshing with said rack on said slide member, said driven gear including a transmission gear and a locating gear that are integrally formed into one unit, said transmission gear having teeth adapted to engage with said locating holes on said housing; and said gear set also including a unidirectional catch means provided between said driving gear and said driven gear, said unidirectional catch means being adapted to bring said driven gear to rotate forward along with said driving gear when the latter rotates forward, and to idle when said driving gear rotates in a reverse direction;

whereby when said handle of said slide member is alternately pulled upwardly and released, said driving gear meshing with said rack is caused by said rack to rotate forwardly and backwardly, respectively, and said driven gear is caused by said unidirectional catch means to rotate in one forward direction with said teeth of said transmission gear engaging with said locating holes on said housing to gradually move said armrest support upward in multiple stages and guided by said spaced locating holes, and a spring connected at an upper end to a lower outer end of said handle to provide a restoring force for elastically pulling said slide member to an initial lower position when said handle is pulled upwardly and then released.

2. The gear-controlled height-adjusting mechanism for the armrest of the office chair as claimed in claim 1, further comprising a cover that is screwed to said armrest support to shield an outer side of said gear set and prevent accessories and parts thereof from exposing to external environments or separating from said armrest support; and said spring being connected to a lower end to a top of said cover.

3. The gear-controlled height=adjusting mechanism for the armrest of the office chair as claimed in claim 1, wherein said catch means includes a base axially projected from one side of said driving gear toward said driven gear, said axially projected base being formed on a circumferential surface at two diametrically opposite sides with two curved recesses for each receiving a ratchet therein, said ratchets being held to said base with a retaining ring, such that said transmission gear of said driven gear is provided with a central hole having radially extended valleys and teeth alternated along an inner wall of said central hole, and said base on said driving gear being received in said central hole of said transmission gear with said two ratchets engaging with one of said valleys in said central hole to bring said driven gear to rotate forward along with said driving gear.

4. The gear-controlled height-adjusting mechanism for armrest of office chair as claimed in claim 1, further comprising a catch pawl member connected to said armrest support via a pivotal shaft and including a hooking hole and a retaining tooth, said catch pawl member being located above said driven gear with said retaining tooth bearing against a tooth flank of said locating gear, such that said locating gear is allowed to rotate forward without being stopped by said retaining tooth of said catch pawl member, and is stopped by said retaining tooth from rotating rearwardly.

5. The gear-controlled height-adjusting mechanism for the armrest of the office chair as claimed in claim 4, further comprising a release mechanism that includes a vertically extended long slot provided near an upper end of said main body of said armrest support, a bar horizontally projected from an upper rear end of said slide member for extending through said long slot, a push member pivotally connected at an end via a pivotal shaft to a rear side of said armrest support to locate above and abut at a lower middle point on said bar extended through said long slot, a return spring mounted between the flat top portion of said armrest support and said push member to normally push said push member to a low position, and a vertically extended link having an upper end connected to another end of said push member opposite to said pivotal shaft and a lower end engaged with said hooking hole on said catch pawl member; whereby when said slide member is pulled to a highest position possible, said rearward extended bar drives said push member to pivotally turn about said pivotal shaft and accordingly lift said link, causing said catch pawl member connected to the lower end of said link to pivotally rotate and said retaining tooth to disengage from the tooth flank of said locating gear, and therefore allowing said locating gear to idle freely and said armrest support to be freely pushed downward.

6. A gear-controlled height-adjusting mechanism for an armrest of an office chair, comprising:

a T-shaped armrest support including a flat top portion for the armrest to mount thereto and a flat long body extending downwardly from said flat top portion for fixing to a side of the office chair;

a housing having at one side of an inner wall surface thereof a vertical row equally spaced locating holes, wherein said armrest support is upwardly and downwardly slidably mounted in said housing;

an elongate slide member movably connected to an upper outer side of said armrest support, such that said slide member can be pulled upward and released to elastically return to a lower position relative to said armrest support, said slide member including a handle laterally outwardly extending from a top of said slide member, and a rack downwardly extending from a lower end of said slide member with a plurality of teeth of said rack projected toward said armrest support;

a gear set including a driving gear and a driven gear, which are connected to each other with a pivotal shaft to mount in an opening provided at a middle portion of said armrest support, said driving gear meshing with said rack on said slide member, said driven gear including a transmission gear and a locating gear that are integrally formed into one unit, said transmission gear having teeth adapted to engage with said locating holes on said housing; and said gear set also including a unidirectional catch means provided between said driving gear and said driven gear, said unidirectional catch means being adapted to bring said driven gear to rotate forward along with said driving gear when the latter rotates forward, and to idle when said driving gear rotates in a reverse direction;

whereby when said handle of said slide member is alternately pulled upwardly and released, said driving gear meshing with said rack is caused by said rack to rotate forwardly and backwardly, respectively, and said driven gear is caused by said unidirectional catch means to rotate in one forward direction with said teeth of said transmission gear engaging with said locating holes on said housing to gradually move said armrest support upward in multiple stages and guided by said spaced locating holes, and wherein said catch means includes a base axially projected from one side of said driving gear toward said driven gear, said axially projected base being formed on a circumferential surface at two diametrically opposite sides with two curved recesses for each receiving a ratchets could swing by a small span in a reverse direction only; and wherein said transmission gear of said driven gear is provided with a central hole having radially extended valleys and teeth alternated along an inner wall of said central hole, and said base on said driving gear being received in said central hole of said transmission gear with said two ratchets separately engaging with one of said valleys in said central hole to bring said driven gear to rotate forward along with said driving gear.

7. A gear-controlled height-adjusting mechanism for an armrest of an office chair, comprising:

a T-shaped armrest support including a flat top portion for the armrest to mount thereto and a flat long body extending downwardly from said flat top portion for fixing to a side of the office chair;

a housing having at one side of an inner wall surface thereof a vertical row of equally spaced locating holes, wherein said armrest support is upwardly and downwardly slidably mounted in said housing;

an elongate slide member movably connected to an upper outer side of said armrest support, such that said slide member can be pulled upward and released to elastically return to a lower position relative to said armrest support, said slide member including a handle laterally outwardly extending from a top of said slide member, and a rack downwardly extending from a lower end of said slide member with a plurality of teeth of said rack projected toward said armrest support;

a gear set including a driving gear and a driven gear, which are connected to each other with a pivotal shaft to mount in an opening provided at a middle portion of said armrest support, said driving gear meshing with said rack on said slide member, said driven gear including a transmission gear and a locating gear that are integrally formed into one unit, said transmission gear having teeth adapted to engage with said locating holes on said housing; and said gear set also including a unidirectional catch means provided between said driving gear and said driven gear, said unidirectional catch means being adapted to bring said driven gear to rotate forward along with said driving gear when the latter rotates forward, and to idle when said driving gear rotates in a reverse direction;

whereby when said handle of said slide member is alternately pulled upwardly and released, said driving gear meshing with said rack is caused by said rack to rotate forwardly and backwardly, respectively, and said driven gear is caused by said unidirectional catch means to rotate in one forward direction with said teeth of said transmission gear engaging with said locating holes on said housing to gradually move said armrest support upward in multiple stages and guided by said spaced locating holes, and a catch pawl member connected to said armrest support via a pivotal shaft and including a hooking hole and a retaining tooth, said catch pawl member being located above said driven gear with said retaining tooth bearing against a tooth flank of said locating gear, such that said locating gear is allowed to rotate forward without being stopped by said retaining tooth of said catch pawl member, and is stopped by said retaining tooth from rotating rearwardly.

8. The gear-controlled height-adjusting mechanism for the armrest of the office chair as claimed in claim 7, further comprising a released mechanism that includes a vertically extended long slot provided near an upper end of said main body of said armrest support, a bar horizontally projected from an upper rear end of said slide member for extending through said long slot, a push member pivotally connected at an end via a pivotal shaft to a rear side of said armrest support to locate above and abut at a lower middle point on said bar extended through said long slot, a return spring mounted between the flat top portion of said armrest support and said push member to normally push said push member to a low position, and vertically extended link having an upper end connected to another end of said push member opposite to said pivotal shaft and a lower end engaged with said hooking hole on said catch pawl member; whereby when said slide member is pulled to a highest position possible, said rearward extended bar drives said push member to pivotally turn about said pivotal shaft and accordingly lift said link, causing said catch pawl member connected to the lower end of said link to pivotally rotate and said retaining tooth to disengage from the tooth flank of said locating gear, and therefore allowing said locating gear to idle freely and said armrest support to be freely pushed downward.

* * * * *